US007047998B2

(12) United States Patent
McKee

(10) Patent No.: US 7,047,998 B2
(45) Date of Patent: May 23, 2006

(54) GRAVITY FLOW DRAIN EXTENSION FOR A CONDENSATION DRAIN LINE

(76) Inventor: David McKee, 10019 Paradise Ridge Rd., Charlotte, NC (US) 28277

( * ) Notice: Subject to any disclaimer, the term of this patent is extended or adjusted under 35 U.S.C. 154(b) by 6 days.

(21) Appl. No.: 10/963,092

(22) Filed: Oct. 12, 2004

(65) Prior Publication Data

US 2006/0076055 A1 Apr. 13, 2006

(51) Int. Cl.
*F25D 21/14* (2006.01)

(52) U.S. Cl. ..... 137/216; 137/357; 62/285

(58) Field of Classification Search ..... 137/883, 137/216, 357; 62/285
See application file for complete search history.

(56) References Cited

U.S. PATENT DOCUMENTS 6,301,917 B1 * 10/2001 Lacoste ..... 62/286
6,343,480 B1 * 2/2002 Correa et al. ..... 62/288
6,527,005 B1 * 3/2003 Weaver ..... 137/312
6,584,795 B1 * 7/2003 Bruss ..... 62/285
6,584,995 B1 * 7/2003 Kimbrough et al. ..... 137/240

* cited by examiner

*Primary Examiner*—John Fox
(74) *Attorney, Agent, or Firm*—Schwartz Law Firm P.C.

(57) ABSTRACT

A gravity flow drain extension is adapted for attachment to an exit opening of a condensation drain line. The drain extension includes an extension line for receiving and transporting water. The open connecting end of the extension line is attached to the exit opening of the condensation drain line, such that water exiting the condensation drain line enters the extension line. The extension line defines at least one discharge opening downstream of its connecting end for dispensing water at a location away from the exit opening of the condensation drain line. A backflow preventer upstream of the at least one discharge opening prevents backflow of water into the condensation drain line.

20 Claims, 10 Drawing Sheets

GRAVITY FLOW DRAIN EXTENSION FOR A CONDENSATION DRAIN LINE

TECHNICAL FIELD AND BACKGROUND OF THE INVENTION

This invention relates to a gravity flow drain extension designed for connecting to an air conditioner's existing condensation drain line. The invention comprises an assembly of parts packaged together in a single convenient kit. Once installed, the invention effectively manages condensation runoff by carrying the water away from the house to a more desirable location for discharge. The runoff may be incorporated in a drip irrigation system, or simply fed to a catch basin or other suitable drain.

During summer months, a home's air conditioning system can produce a considerable amount of condensation runoff—as much as three to five gallons per day is not uncommon. In most homes, a condensation drain line formed of PVC pipe extends from the AC unit located inside the home to a discharge point outside of the home. This discharge point is typically within 4–12 inches from the foundation. While many homeowners choose to ignore this slow drip or trickle of water, over the course of a day the amount of water discharged in this one location is not good for the foundation, and is not optimal for plants or vegetation close to the home. Over a more extended period, water may begin to pool, killing areas of the lawn and creating a rather muddy wet environment conducive to mosquitos and other insects, algae, mold growth, and fungal diseases. This runoff may also cause unnecessary settling of the foundation due to softening earth in and around the crawl space and footing.

The present invention addresses this issue by providing a gravity flow drain extension designed to conveniently retrofit to the existing condensation drain line projecting from the home. The invention effectively manages and distributes the normal condensation runoff produced by the AC unit in a manner which is better for the homeowner and better for the surrounding environment. The invention is quickly and easily installed without special tools or the help of a professional.

SUMMARY OF INVENTION

Therefore, it is an object of the invention to provide a gravity flow drain extension designed for connecting to an air conditioner's existing condensation drain line to disperse water away from the exiting opening of the drain line to a more desirable location.

It is another object of the invention to provide a gravity flow drain extension which is quickly and easily installed.

It is another object of the invention to provide a gravity flow drain extension which includes an assembly of parts conveniently packaged and sold in a single kit.

It is another object of the invention to provide a gravity flow drain extension which may incorporate a drip irrigation system for surrounding plants, bushes, shrubs, and other vegetation.

It is another object of the invention to provide a gravity flow drain extension which is especially adapted for installation by the do-it-yourself homeowner.

It is another object of the invention to provide a gravity flow drain extension which can be installed without special tools or professional assistance.

It is another object of the invention to provide a gravity flow drain extension which delivers water to a desired location without creating an overly moist environment that promotes mold, algae, mosquitos, fungal diseases, and foundation settling.

It is another object of the invention to provide a gravity flow drain extension which protects the structural integrity of the home or building's foundation.

It is another object of the invention to provide a gravity flow drain extension which reduces soil erosion on slopes.

It is another object of the invention to provide a condensation drain line which incorporates the present gravity flow drain extension.

It is another object of the invention to provide an air conditioner system including a condensation drain line which incorporates the present gravity flow drain extension.

It is another object of the invention to provide a method for managing water flow from a condensation drain line of an air conditioner system.

It is another object of the invention to capture, store, and recycle condensation runoff for subsequent use in air coolant systems for attics and/or garages, land irrigation systems, washing cars, and other commercial, residential, and recreational uses. The water may be stored in an aboveground or underground tank and dispensed, as needed, for any desired application.

These and other objects of the present invention are achieved in the preferred embodiments disclosed below by providing a gravity flow drain extension adapted for attachment to an exit opening of a condensation drain line projecting from an exterior wall of a building. The drain extension includes an extension line for receiving and transporting water. Means are provided for attaching an open connecting end of the extension line to the exit opening of the condensation drain line, such that water exiting the condensation drain line enters the extension line. The extension line defines at least one discharge opening downstream of its connecting end for dispensing water at a location away from the exit opening of the condensation drain line. This location may be at a catch basin, storm drain, a remote storage tank, or the like. A backflow preventer upstream of the at least one discharge opening prevents backflow of water into the condensation drain line.

According to another preferred embodiment, the extension line includes an elbow fitting downstream of the open connecting end, and adapted for directing an angled gravity flow of water exiting the condensation drain line.

According to another preferred embodiment, the extension line further includes a rigid decline section connected to the elbow fitting, and angled such that water moving downstream from the open connecting end maintains smooth continuous contact with a lower surface of the decline section.

According to another preferred embodiment, the backflow preventer includes a tee fitting formed with the decline section. The tee fitting defines an open window facing away from the gravity flow of water, whereby any water build-up inside the extension line is diverted through the window prior to re-entry into the condensation drain line.

According to another preferred embodiment, mesh screen covers the window of the tee fitting to prevent entry of debris into the extension line.

According to another preferred embodiment, the extension line includes a flexible tube section.

According to another preferred embodiment, a plurality of spaced-apart drip emitters are connected to the flexible tube section.

According to another preferred embodiment, means are provided for closing an open free end of the flexible tube section.

According to another preferred embodiment, the means for closing comprises a figure-eight clip.

In another embodiment, the invention is a condensation drain line projecting from an exterior wall of a building, and including a gravity flow drain extension adapted for attachment to an exit opening of the condensation drain line. The drain extension includes an extension line for receiving and transporting water. Means are provided for attaching an open connecting end of the extension line to the exit opening of the condensation drain line, such that water exiting the condensation drain line enters the extension line. The extension line defines at least one discharge opening downstream of its connecting end for dispensing water at a location away from the exit opening of the condensation drain line. A backflow preventer upstream of the at least one discharge opening prevents backflow of water into the condensation drain line.

In yet another embodiment, the invention is an air conditioner unit located inside a building and including a condensation drain line extending from the air conditioner unit through an exterior wall of the building for discharge outside of the building. A gravity flow drain extension is adapted for attachment to an exit opening of the condensation drain line. The drain extension includes an extension line for receiving and transporting water. Means are provided for attaching an open connecting end of the extension line to the exit opening of the condensation drain line, such that water exiting the condensation drain line enters the extension line. The extension line defines at least one discharge opening downstream of its connecting end for dispensing water at a location away from the exit opening of the condensation drain line. A backflow preventer upstream of the at least one discharge opening prevents backflow of water into the condensation drain line.

In yet another embodiment, the invention is a method for directing water flow from a condensation drain line of an air conditioner unit. The condensation drain line extends from the air conditioner unit through an exterior wall of a building for discharge outside of the building. The method includes the steps of attaching an extension line of a gravity flow drain extension to an exit opening of the condensation drain line, such that water exiting the condensation drain line enters the extension line. A discharge opening of the extension line is then located away from the exit opening of the condensation drain line. Backflow of water is prevented from the extension line into the condensation drain line.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
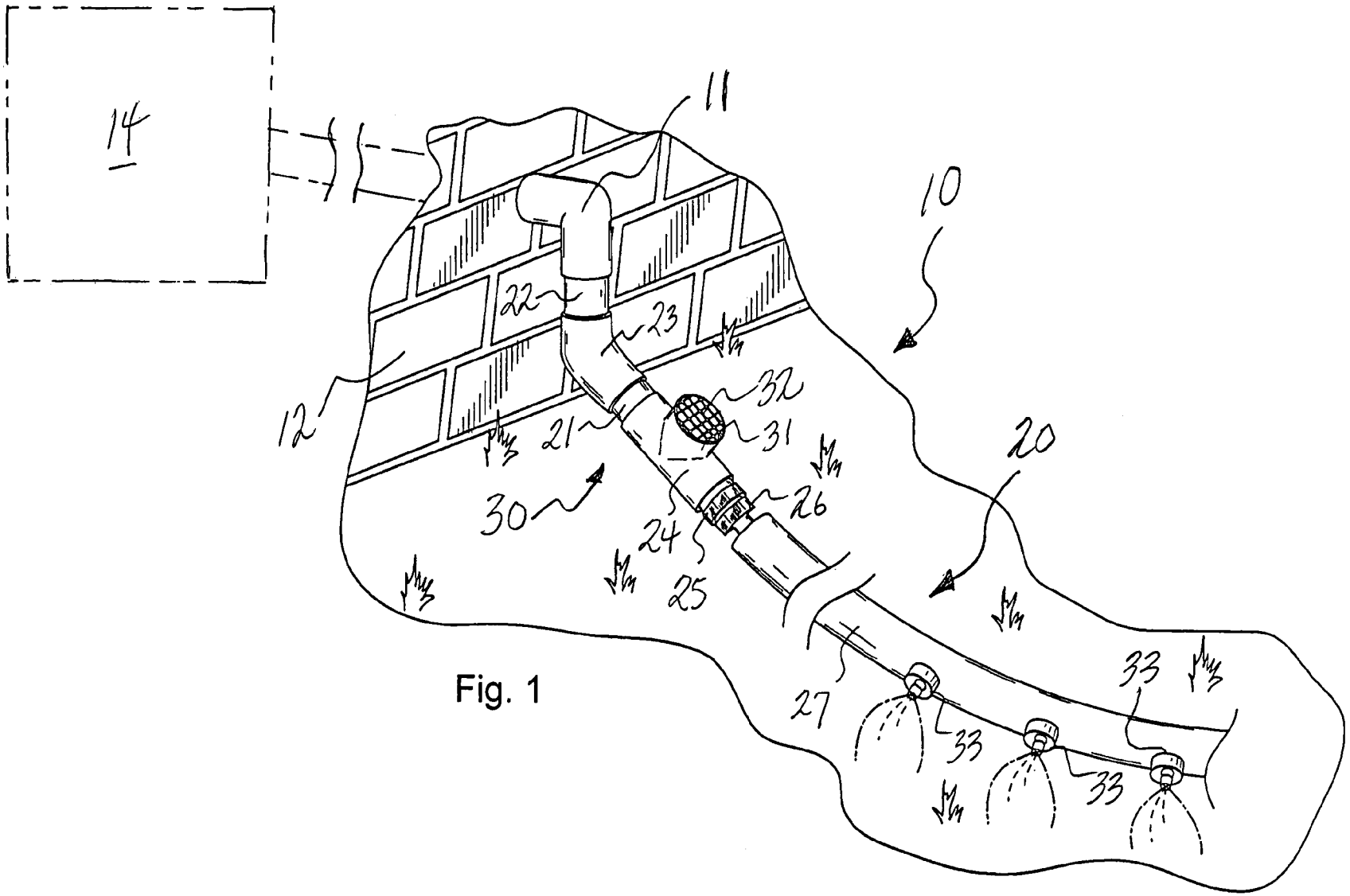
FIG. 1 is an environmental perspective view of a gravity flow drain extension according to one preferred embodiment of the present invention, and showing the drain extension connected to an exit opening of an existing condensation drain line extending from an air conditioner unit (shown schematically in phantom)

Referring now specifically to the drawings, a gravity flow drain extension according to the present invention is illustrated in FIG. 1, and shown generally at reference numeral 10. The drain extension 10 communicates with an exit opening of an existing condensation drain line 11 projecting from an exterior wall 12 of a building. The condensation drain line 11 extends from an air conditioner unit 14 located inside the building. The drain extension 10 is applicable for use on any residential home, commercial facility, or other structure.

Figure 2:
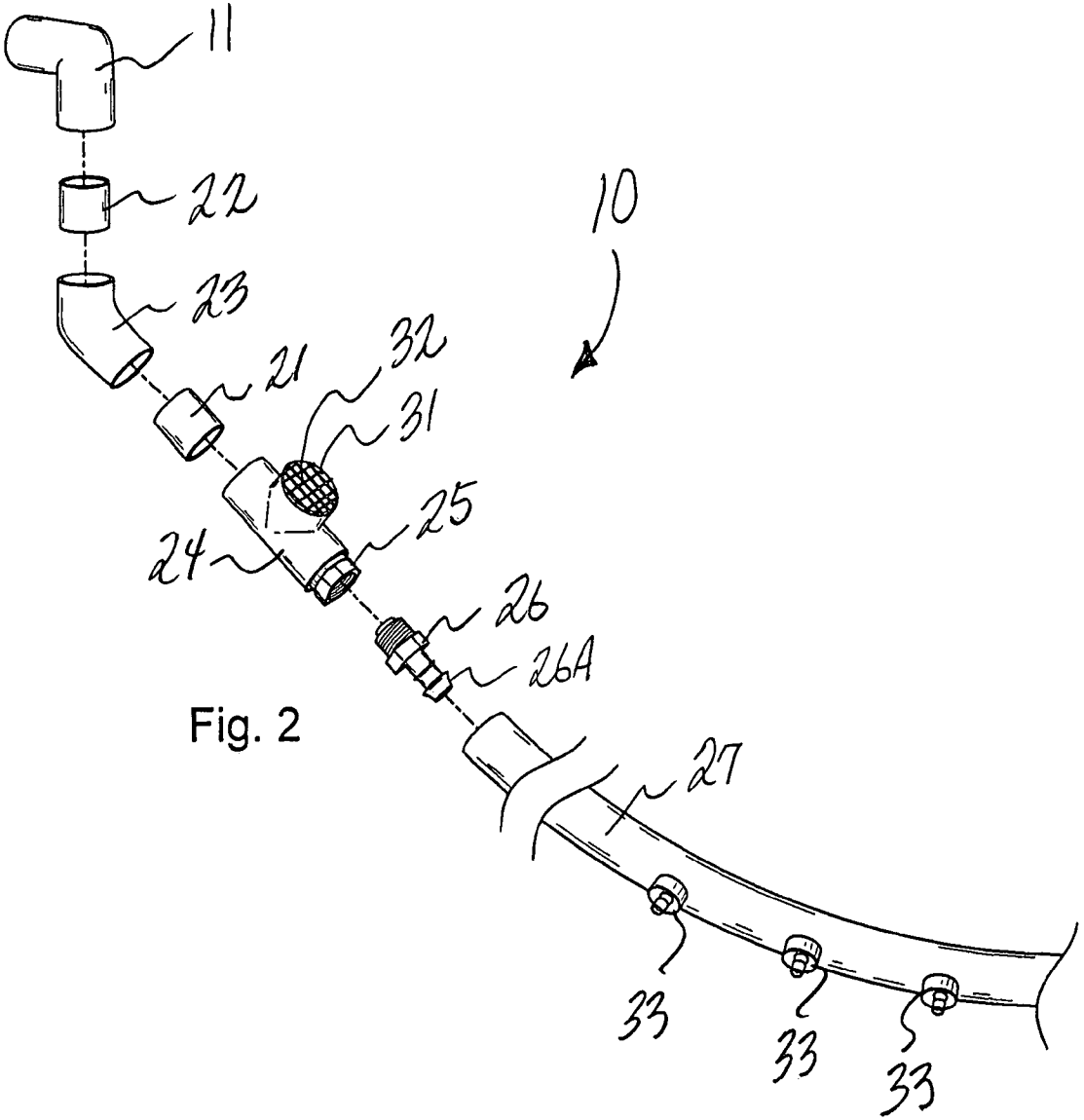
FIG. 2 is a substantially disassembled, exploded view of the drain extension.
Figure 3:
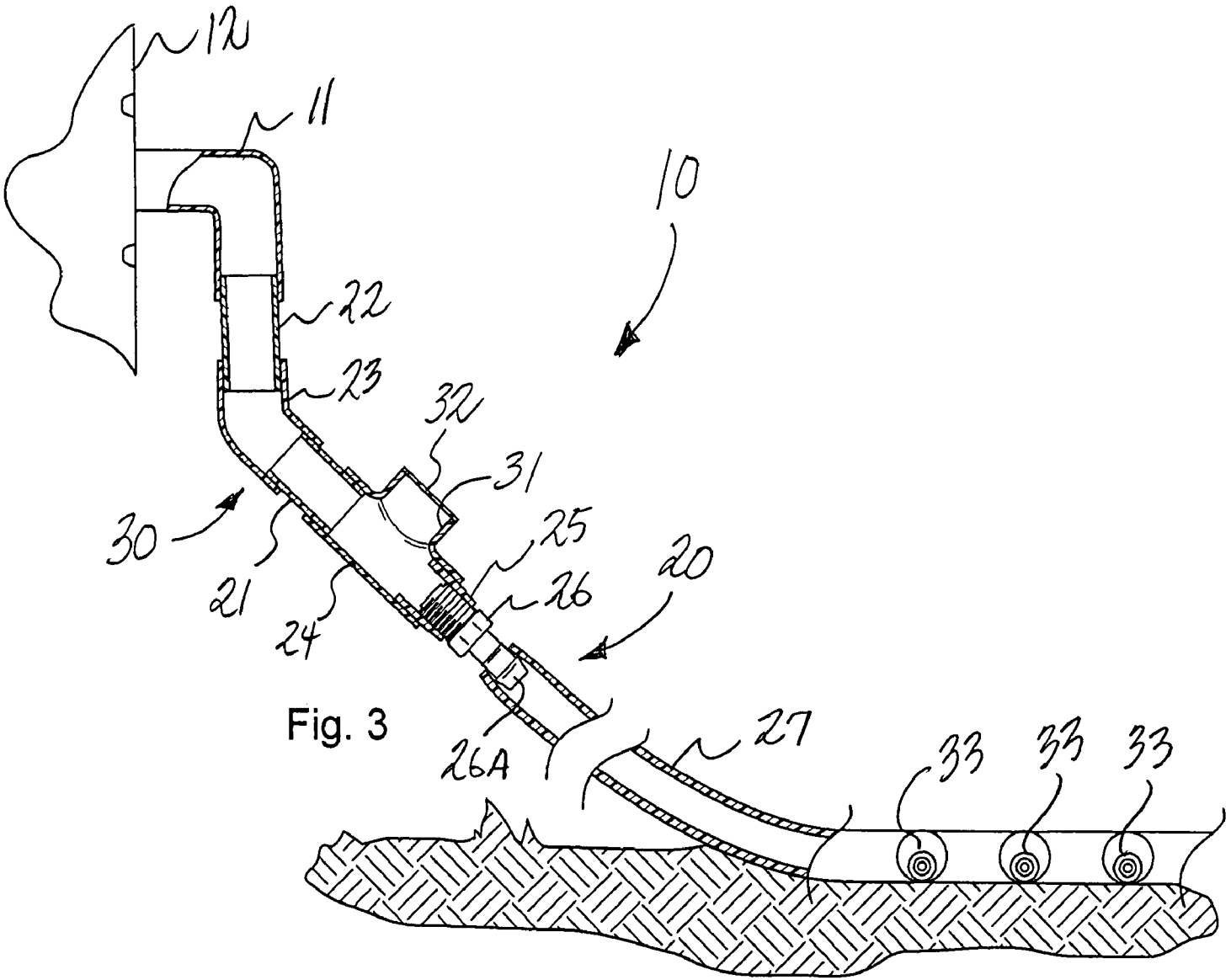
FIG. 3 is an assembled, cross-sectional view of a portion of the drain extension attached to the condensation drain line.
Figure 4:
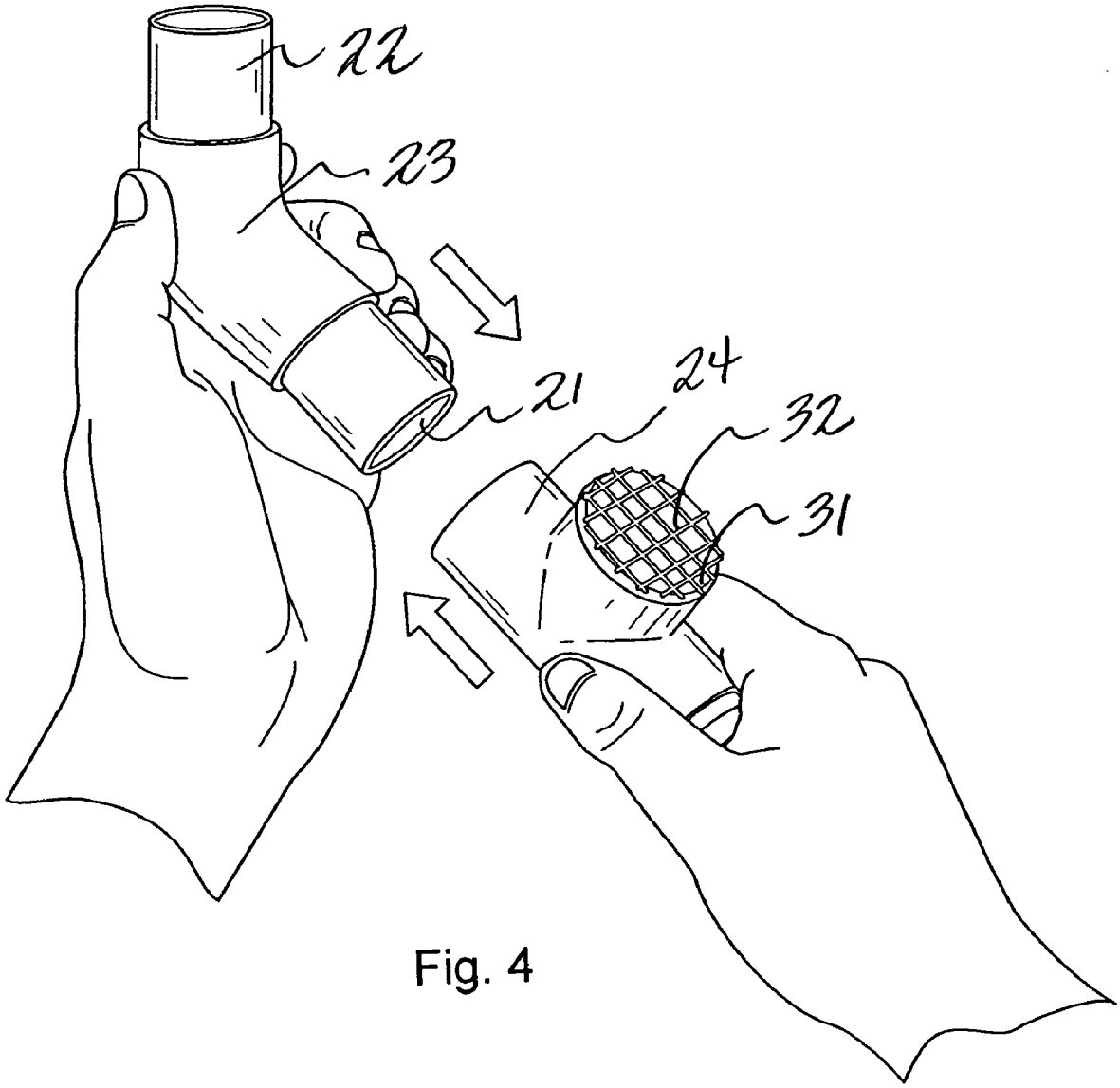
FIG. 4 is a view illustrating attachment of the elbow fitting and tee fitting of a decline section of the extension line.
Figure 5:
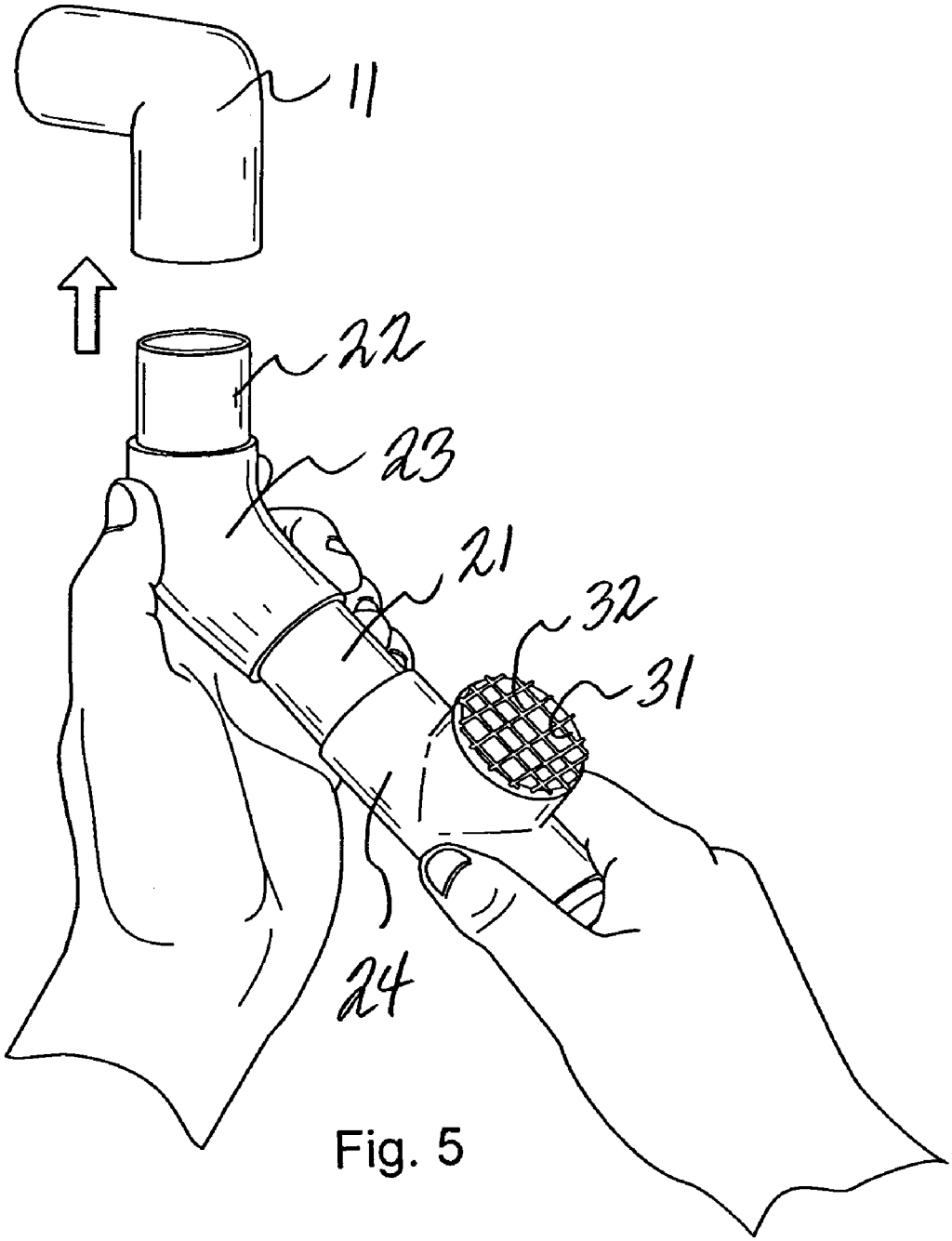
FIG. 5 is a view illustrating attachment of the decline section to the exit opening of the condensation drain line.
Figure 6:
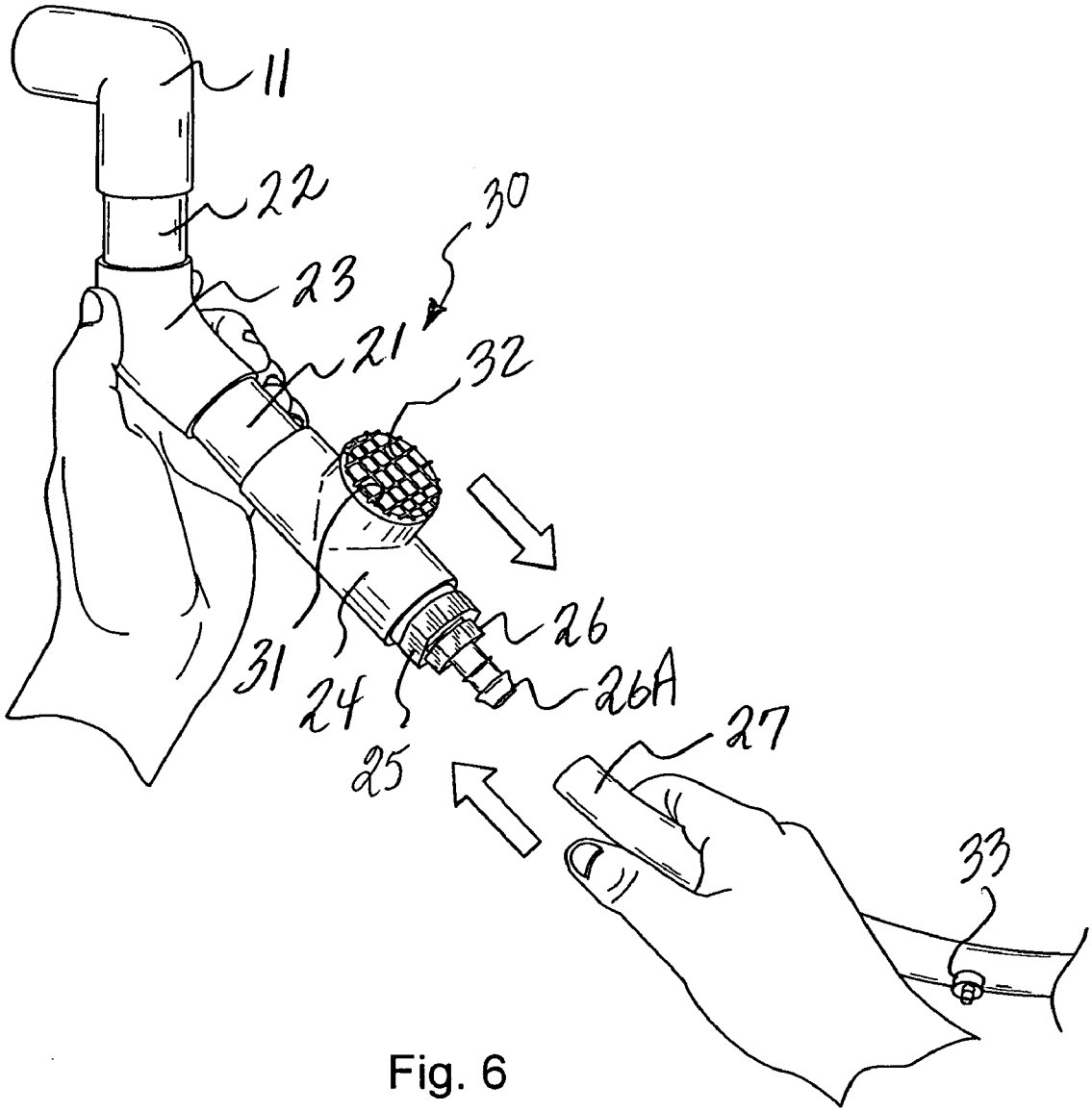
FIG. 6 is a view illustrating attachment of the flexible hose to an end of the decline section.

The drain extension 10 includes an extension line 20 comprising an assembly of separate and replaceable parts, best shown in FIGS. 2 and 3, packaged in a single convenient kit. The parts are interconnected using any suitable adhesive, such as PVC cement, a thread connection, or friction fit. According to the embodiment shown, a pair of male PVC couplings 21 and 22 are attached to respective openings of a 45-degree PVC socket elbow fitting 23. The first male coupling 21 further attaches to a PVC tee fitting 24, as shown in FIG. 4. The second male coupling 22 further attaches directly to the exit opening of the condensation drain line 11, as shown in FIG. 5. A reducer bushing 25 and male adapter 26 are located at the second open end of the tee fitting 24. The male adapter 26 fits inside the reducer bushing 25, and comprises a self-sealing spigot end 26A for inserting into a length of flexible hose 27, as shown in FIG. 6.

The male couplings 21, 22, elbow fitting 23, tee fitting 24, reducer bushing 25, and male adapter 26 cooperate to form a rigid decline section 30 of the extension line 20. The decline section 30 is angled such that water entering the drain extension 10 from the existing condensation drain line 11 and moving downstream through the extension line 20 maintains smooth continuous contact with a lower inside surface of the decline section 30. The angle of the decline section 30, shown in FIG. 3, is coupling 22. The third opening 31 of the tee fitting 24 faces away from the lower inside surface of the decline section 30 and forms a backflow preventer, as described further below, designed to prevent backflow of water into the condensation drain line 11. A mesh screen 32 covers the opening 31 to prevent entry of debris, insects, and other objects into the extension line 20.

Figure 7:
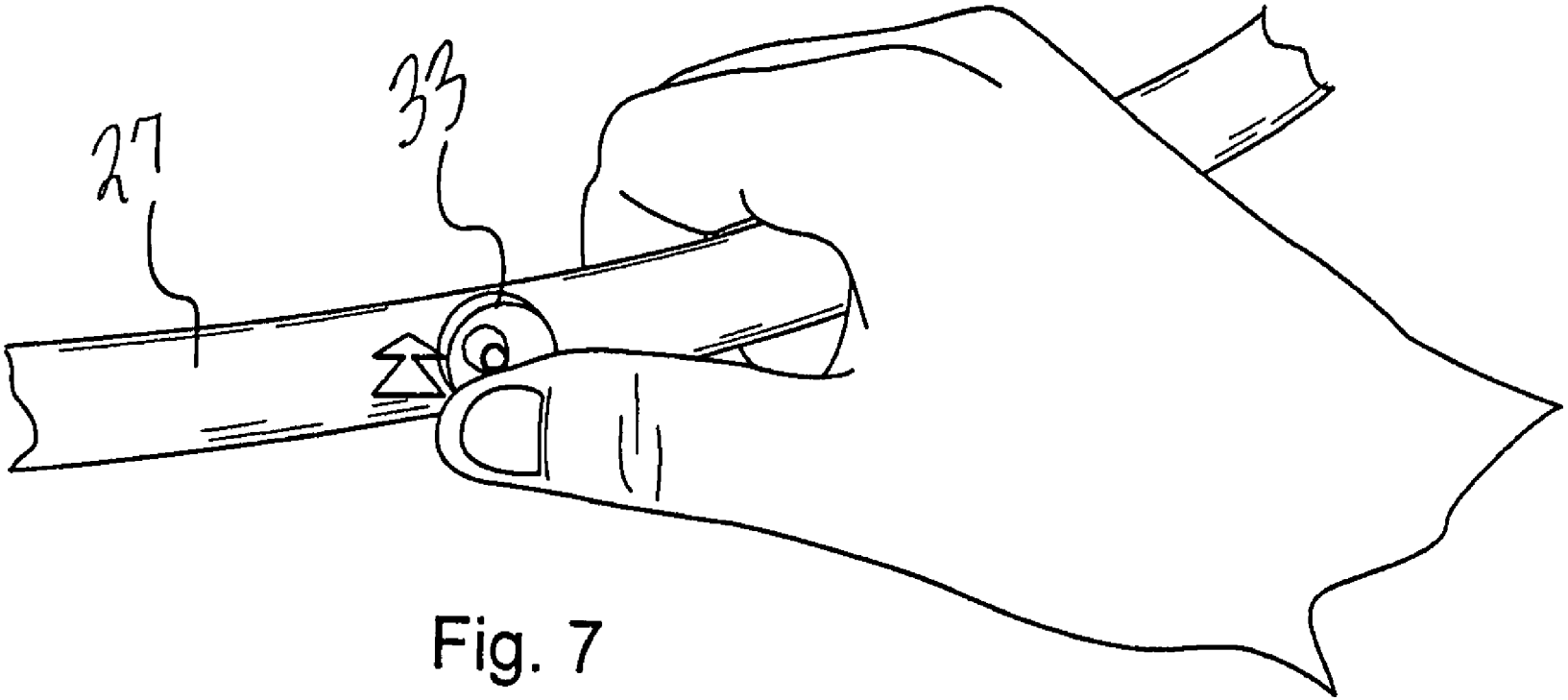
FIG. 7 is a view demonstrating adjustment of a drip emitter.
Figure 8:
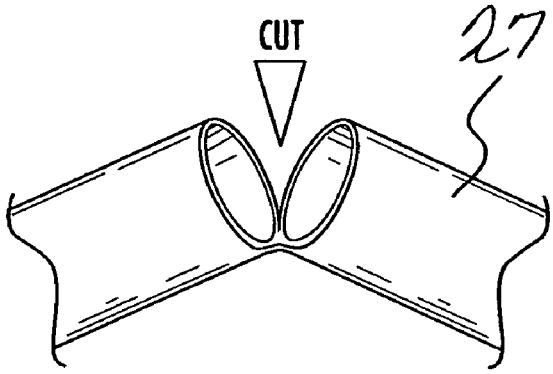
FIG. 8 is a view showing the flexible hose cut to form its free end.
Figure 9:
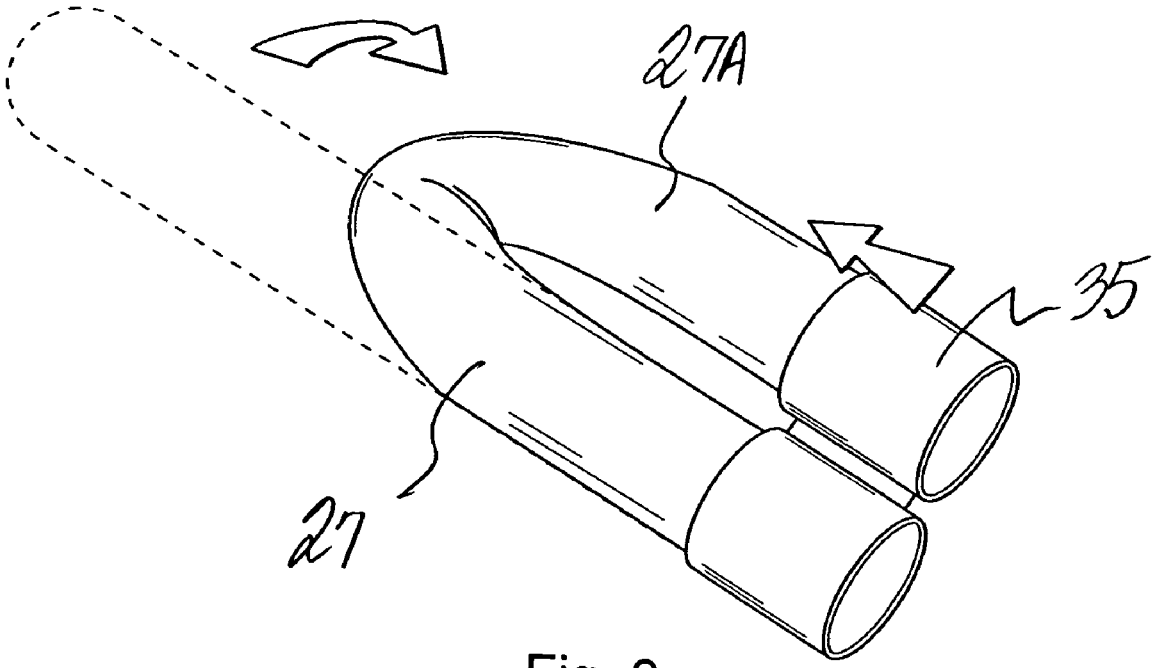
FIG. 9 is a view showing the free end of the hose folded over and closed using a figure-eight clip.

Preferably, the flexible hose 27 comprises black polyethylene tubing commonly known as "drip hose". A number of spaced-apart drip emitters 33 are connected along the length of the hose 27 and define respective water discharge openings intended to irrigate bushes, shrubbery, and other plantings. Once connected, the drip emitters 33 are rotated, as shown in FIG. 7, to control the amount water discharged at various points along the hose 27. After cutting the hose 27 to the desired length, as shown in FIG. 8, the free end 27A is folded over and closed using a figure-eight clip 35, shown in FIG. 9, or other suitable means, such as an end cap. Alternatively, the hose 27 may extend directly away from the building foundation, and discharge water through an open free end into a catch basin or other more desirable location. The hose 27 is preferably secured to the ground using metal or plastic landscape staples (not shown).

Figure 10:
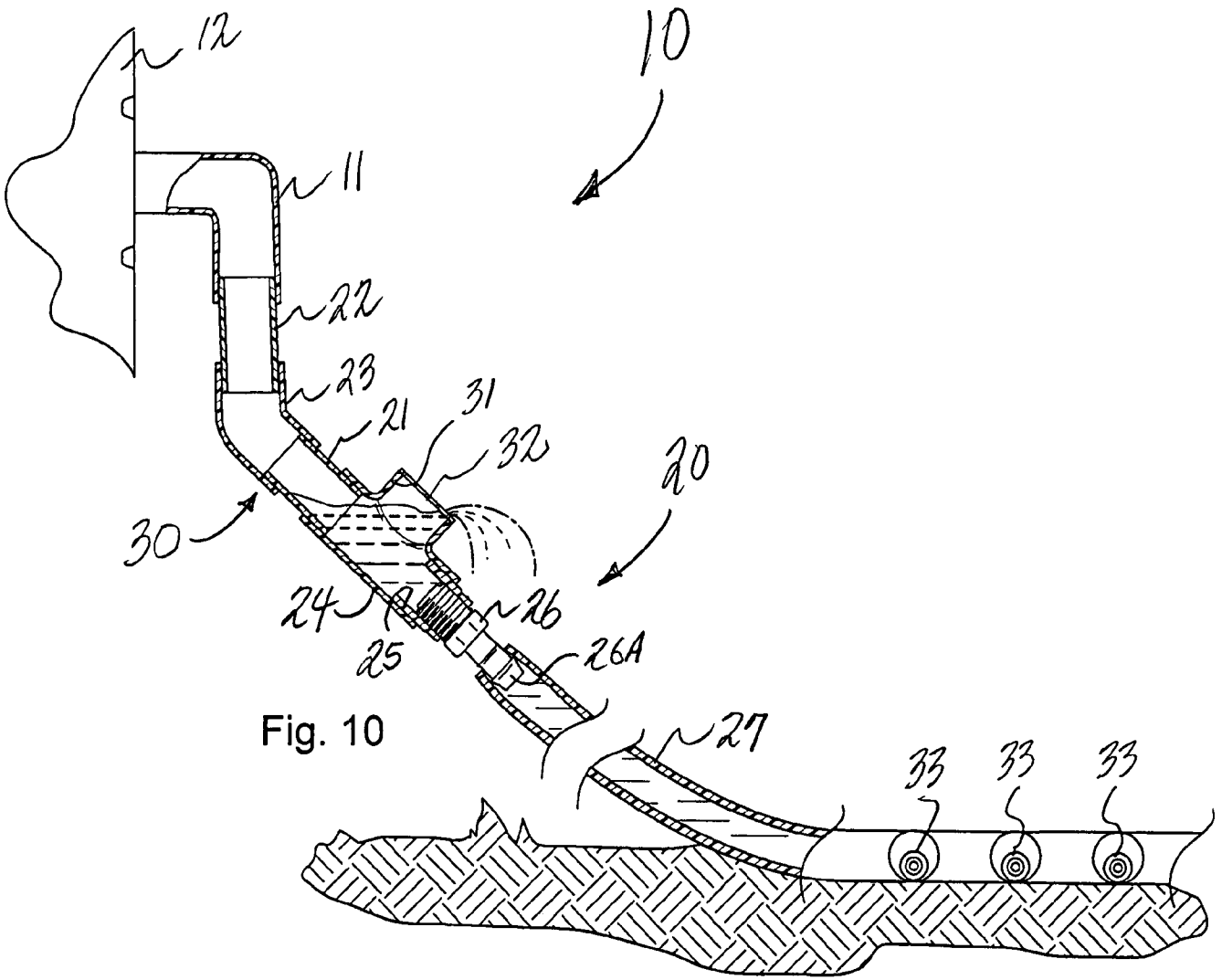
FIG. 10 is a cross-sectional view of a portion of the drain extension attached to the condensation drain line, and demonstrating operation of the backflow preventer.

Referring to FIG. 10, in the event one or more of the discharge openings in the extension line 20 becomes clogged, the opening 31 in the tee fitting 24 allows water to spill outwardly from the drain extension 10 before backflowing into the condensation drain line 11. In addition to backflow prevention, the tee opening 31 forms a window which allows ready and convenient visual inspection to determine proper and effective operation of the drain extension 10. In alternative embodiments, the backflow preventer may comprise any suitable valve, such as an anti-siphon or check valve. For added protection against clogging and backflow, the condensation drain extension 10 should be thoroughly flushed prior to attachment to the condensation drain line 11.

Figure 11:
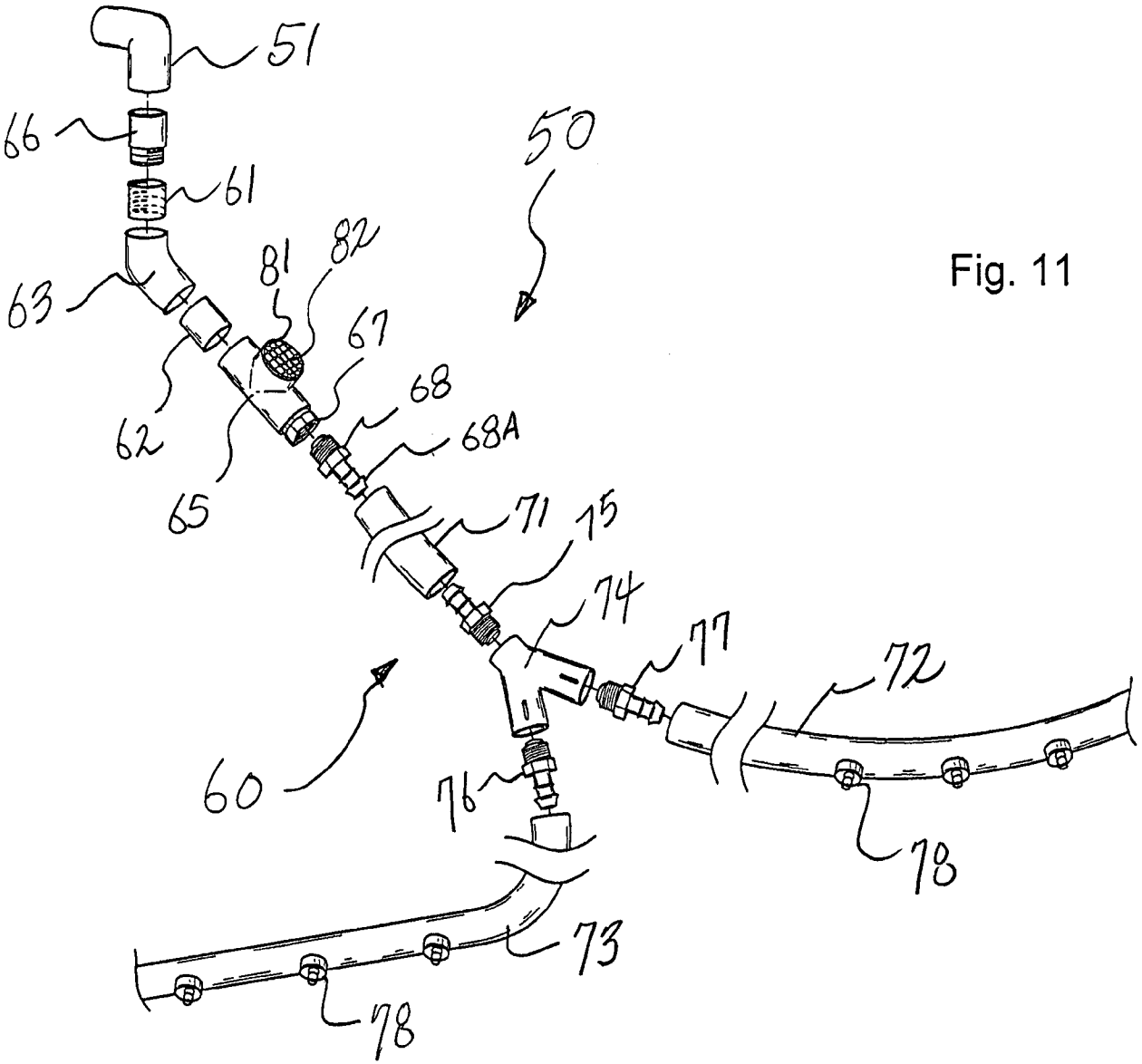
FIG. 11 is a substantially disassembled, exploded view of the drain extension according to a second preferred embodiment of the present invention.

An alternative embodiment of a condensation drain extension 50 according to the invention is illustrated in FIG. 11. As previously described, the drain extension 50 communicates with an exit opening of an existing condensation drain line 51 projecting from an air conditioning unit (not shown) located either inside or outside of a building. The drain extension 50 includes an extension line 60 comprising an assembly of separate and replaceable parts. In the embodiment shown, a pair of male PVC couplings 61 and 62 are attached to respective openings of a 45-degree PVC socket elbow fitting 63. The first male coupling 61 further attaches to a PVC tee fitting 65. The second male coupling 62 has an internal thread which mates with a complementary thread of a male connector 66 attached directly to the exit opening of the condensation drain line 51. This threaded connection allows ready and convenient attachment and detachment of the drain extension 50 from the existing drain line 51.

A reducer bushing 67 and male adapter 68 are located at the second open end of the tee fitting 65. The male adapter 68 fits inside the reducer bushing 67, and comprises a self-sealing spigot end 68A for inserting into a length of flexible hose. The flexible hose may comprise multiple lines 71, 72, and 73 interconnected by a suitable connector 74, such as the Y-connector shown, with internal valves for controlling water flow through each of lines 72 and 73. The Y-connector 74 is attached at any desired location using respective male adapters 75, 76, and 77. A number of spaced-apart drip emitters 78 are connected along the length of the hoses 72, 73 and define respective water discharge openings intended to irrigate bushes, shrubbery, and other plantings.

As previously described, a third opening 81 of the tee fitting 65 forms a backflow preventer designed to prevent backflow of water into the condensation drain line 51. A mesh screen 82 covers the opening 81 to prevent entry of debris, insects, and other objects into the extension line 60. In the event one or more of the discharge openings in the extension line 60 becomes clogged, the opening 81 in the tee fitting 65 allows water to spill outwardly from the drain extension 50 before backflowing into the condensation drain line 51. In addition to backflow prevention, the tee opening 81 forms a window which allows ready and convenient visual inspection to determine proper and effective operation of the drain extension 50.

A gravity flow drain extension is described above. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims.

I claim:

1. A gravity flow drain extension adapted for attachment to an exit opening of a condensation drain line, said drain extension comprising:

an extension line for receiving and transporting water;

means for attaching an open connecting end of said extension line to the exit opening of the condensation drain line, such that water exiting the condensation drain line enters said extension line;

said extension line defining at least one discharge opening downstream of its connecting end for dispensing water at a location away from the exit opening of the condensation drain line; and a backflow preventer upstream of said at least one discharge opening for preventing backflow of water into the condensation drain line.

2. A drain extension according to claim 1, wherein said extension line comprises an elbow fitting downstream of the open connecting end, and adapted for directing an angled gravity flow of water exiting the condensation drain line.

3. A drain extension according to claim 2, wherein said extension line further comprises a rigid decline section connected to said elbow fitting, and angled such that water moving downstream from the open connecting end maintains smooth continuous contact with a lower surface of said decline section.

4. A drain extension according to claim 3, wherein said backflow preventer comprises a tee fitting formed with said decline section, and defining an open window facing away from the gravity flow of water, whereby any water build-up inside said extension line is diverted through said window prior to re-entry into the condensation drain line.

5. A drain extension according to claim 4, and comprising a mesh screen covering the window of said tee fitting to prevent entry of debris into said extension line.

6. A drain extension according to claim 1, wherein said extension line comprises a flexible tube section.

7. A drain extension according to claim 6, and comprising a plurality of spaced-apart drip emitters connected to said flexible tube section.

8. A drain extension according to claim 7, and comprising means for closing an open free end of said flexible tube section.

9. A drain extension according to claim 8, wherein said means for closing comprises a figure-eight clip.

10. In combination with a condensation drain line, a gravity flow drain extension adapted for attachment to an exit opening of said condensation drain line, said drain extension comprising:

an extension line for receiving and transporting water;

means for attaching an open connecting end of said extension line to the exit opening of the condensation drain line, such that water exiting the condensation drain line enters said extension line;

said extension line defining at least one discharge opening downstream of its connecting end for dispensing water at a location away from the exit opening of the condensation drain line; and a backflow preventer upstream of said at least one discharge opening for preventing backflow of water into the condensation drain line.

11. A combination according to claim 10, wherein said extension line comprises an elbow fitting downstream of the open connecting end, and adapted for directing an angled gravity flow of water exiting the condensation drain line.

12. A combination according to claim 11, wherein said extension line further comprises a rigid decline section connected to said elbow fitting, and angled such that water moving downstream from the open connecting end maintains smooth continuous contact with a lower surface of said decline section.

13. A combination according to claim 12, wherein said backflow preventer comprises a tee fitting formed with said decline section, and defining an open window facing away from the gravity flow of water, whereby any water build-up inside said extension line is diverted through said window prior to re-entry into the condensation drain line.

14. A combination according to claim 13, and comprising a mesh screen covering the window of said tee fitting to prevent entry of debris into said extension line.

15. A combination according to claim 10, wherein said extension line comprises a flexible tube section.

16. A combination according to claim 15, and comprising a plurality of spaced-apart drip emitters connected to said flexible tube section.

17. A combination according to claim 16, and comprising means for closing an open free end of said flexible tube section.

18. A combination according to claim 17, wherein said means for closing comprises a figure-eight clip.

19. In combination with an air conditioner unit comprising a condensation drain line, a gravity flow drain extension adapted for attachment to an exit opening of said condensation drain line and comprising:

an extension line for receiving and transporting water;

means for attaching an open connecting end of said extension line to the exit opening of the condensation drain line, such that water exiting the condensation drain line enters said extension line;

said extension line defining at least one discharge opening downstream of its connecting end for dispensing water at a location away from the exit opening of the condensation drain line; and a backflow preventer upstream of said at least one discharge opening for preventing backflow of water into the condensation drain line.

20. A method for managing water flow from a condensation drain line of an air conditioner unit, said method comprising the steps of:

attaching an extension line of a gravity flow drain extension to an exit opening of the condensation drain line, such that water exiting the condensation drain line enters the extension line;

locating a discharge opening of the extension line away from the exit opening of the condensation drain line; and preventing backflow of water from the extension line into the condensation drain line.

* * * * *